United States Patent [19]

Lutz

[11] 4,297,750

[45] Nov. 3, 1981

[54] TOILET AND COVER

[76] Inventor: Rainer M. Lutz, Reichberg 29, 7827 Löffingen, Fed. Rep. of Germany

[21] Appl. No.: 70,355

[22] Filed: Aug. 28, 1979

[51] Int. Cl.[3] ..... A47K 13/18; A47K 13/16

[52] U.S. Cl. ..... 4/247; 4/242; 4/244; 4/243

[58] Field of Search ..... 4/243, 242, 247, 246, 4/233, 244

[56] References Cited

U.S. PATENT DOCUMENTS

| | | | |
|---|---|---|---|
| 887,686 | 5/1908 | Morrison | 4/247 |
| 912,280 | 2/1909 | Brott | 4/247 |
| 949,562 | 2/1910 | Barger | 4/247 |
| 986,586 | 3/1911 | Morrison | 4/247 |
| 1,108,799 | 8/1914 | Shortt | 4/247 |
| 1,589,429 | 6/1926 | Rouse | 4/247 |
| 1,608,988 | 11/1926 | Moroni | 4/247 |
| 1,626,308 | 4/1927 | Thatcher | 4/247 |
| 1,858,794 | 5/1932 | Vallecchi | 4/247 |
| 1,912,363 | 6/1933 | Waide | 4/242 UX |
| 2,079,975 | 5/1937 | Volkmann et al. | 4/247 |
| 2,123,012 | 7/1938 | Kreutzig | 4/247 |
| 2,243,134 | 5/1941 | Stiller | 4/247 |
| 2,440,232 | 4/1948 | Davidson | 4/233 |
| 2,592,167 | 4/1952 | Monaghan | 4/233 |
| 3,751,738 | 8/1973 | Vairo | 4/247 |

*Primary Examiner*—Henry K. Artis

*Attorney, Agent, or Firm*—Herman L. Gordon

[57] ABSTRACT

A toilet assembly including a hinged toilet seat with a rigidly connected coaxial housing containing a roll of paper toilet seat covers sheets the paper being transversely perperated so that the covers can be readily detached, and the housing having a longitudinal dispensing slot for the covers. The assembly also includes an upstanding cistern with a front vertical recess to receive the toilet seat. The cover sheets are formed to define front and rear flaps which can become partially immersed in the water in the associated toilet bowl so as to shield the front and rear inside surfaces of the bowl.

16 Claims, 12 Drawing Figures

TOILET AND COVER

This invention relates to toilet seat covers. The invention refers to a toilet seat with surface protection for avoiding direct bodily contact of a person with the toilet seat in which is provided in the rear region of the toilet pan, for example, in the toilet seat a receiving space an endless role with tear off individual sheets formed as a surface protection.

With known arrangements it has been found disadvantageous for the toilet seat, the lid and the receiving area formed on the seat to have to be mounted in the rear part of the toilet pan. Besides the relatively complicated mounting there is also the disadvantage that the rear part of the toilet pan can never be kept free of impurities which, for example, come in the form of water sprays or urine residues from the toilet pan onto the rear edge of the toilet pan; a cleaning of the rear part of the toilet pan has hitherto not been possible because of the position of the mounting block and bearing and arrangement of the pivots for holding the lid, the seat and other movable parts. This gave rise to considerable hygienic problems.

Since to an increased extent flushing has been carried out with the use of cisterns there is an increased space requirement in the combination of a toilet seat with a cistern for flushing mentioned above. The cistern must be arranged freely and raised a little above the toilet seat. With this it is necessary to dispose the toilet pan in front of the cistern so that the whole arrangement consisting of the cistern box and toilet pan must be arranged relatively space saving. The problem of the present invention is to develop further a toilet seat with support protection of the above mentioned type such that an insanitary soiling of the toilet pan particulary in the rear area is avoided, that the toilet pan is easy to clean and that all operating parts of the toilet such as lid, seat and as the case may be a receiving space for receiving surface protection sheets form a compact independently mountable unit without separate parts having to be mounted.

For the solution of this problem the invention is characterised in that the toilet seat and a lid covering the toilet seat as well as the receiving space for receiving the individual sheets are accommodated in a box/(flushing box).

The essential feature of the present invention is that all operating parts of the toilet (with the exception of course of the toilet pan) are integrated as a compact unit in a box which is arranged directly behind and at a short distance from the toilet pan.

The association of the box and the parts disposed therein such as lid, seat and as the case may be receiving space for receiving surface protection sheets is such that upon turning the seat down and the lid the toilet pan disposed thereunder is covered in a conventional manner. Therefore in a particularly simple manner a fixing of the lid, seat and as the case may be the receiving space on the toilet pan itself is avoided so that by the essential advantage results in that the toilet pan is now easy to clean because no mounting parts or fixing points are arranged on the toilet pan itself.

In a first embodiment of the present invention it is arranged for the box to be formed at the same time as a cistern for flushing. It includes the construction of a box having two chambers one chamber of which is intended for receiving the flushing water and the other chamber is arranged as a receiving space for the paper sheets as surface protection or as a receiving space for the receiving of units for the preparation of hot water and hot air supplied simultaneously to a spray nozzle for the liquid cleaning of the anal region.

It is preferred for the water box to have at the front a sunken trough into which the lid and the seat in the raised position is pivoted. The said parts then close approximately flush with the outer edges of the trough to provide a closed and compact construction of the water box.

In a second embodiment of the present invention it is provided for the box to only serve as a storage box for toilet articles and therefore does not contain two chambers but only a single chamber for the storing of the said articles.

Such a box serves for the use of the toilet seat with surface protection and for water flushing which works with a pressure flusher. A hand operated valve controls the flushing water for the toilet pan directly from the water supply without—as in the embodiment described—a flushing box being inserted there between.

A particularly high degree of integration and a particularly advantageous compact construction of the arrangement according to the invention results due to the fact that at the same time in the lower part of the flushing box a spray nozzle for the liquid cleaning of the anal region is also provided. Associated operating fittings can be arranged on the front or on the side wall of the flushing box. In the receiving space remaining in the flushing box the associated units such as warm water preparing means or a warm air unit for a hot air nozzle can be accommodated.

A further essential feature of the present invention is that it is arranged for the advancing of the paper of the surface protection sheets to be effected automatically upon pivoting of the closed lid. For this purpose there is provided between the pivots of the lid and the bearing of the endless roll a suitable advancing mechanism which consists of a toothed gear wheel with a transmission inserted therebetween. This feature has the advantage that a hand operated drawing out of the surface protection sheets from the receiving space can be dispensed with and always the seat in its position of use is covered automatically with such a surface protection sheet.

Furthermore it is essential for a completely new type of individual sheets to be provided as a surface protection. It is already known to form individual sheets such that in the middle a free opening is left the outer contour of which corresponds approximately to the contour of the toilet seat opening. With the present invention however it is proposed to provide in the region of the seat opening an inner flap inside the individual sheet. The used paper protection surface need not be removed from the toilet by hand as the surface due to one or two flaps hanging in the WC pan upon operation of the WC flush is automatically drawn with the water from the toilet seat and flushed down. The user therefore needs to take hold of this paper protection surface only once before use and draw it over the toilet seat whilst after use due to the flap of the paper protection surface hanging in the water upon actuating the plug the whole paper protection surface is automatically torn off and drawn into the toilet pan where it is then removed with the flushing.

In a second embodiment the inner flap according to the invention is devided by slits into two flaps one flap of which via a connecting piece is connected to the rear area and the other flap is connected via a connecting piece to the front area of the individual sheet. The flaps run to the middle of the seat opening in pointed ends which has the advantage that the length of the flaps is so long that they dip with their free ends into the water of the toilet pan. Tests have shown that the water at the most mounts one to two mm on these flaps therefore does not lead to a wetting of the surface protection itself.

The dipping in of the ends of the front and rear flaps into the water has the advantage that upon operating the water flush the whole surface protection is drawn into the toilet pan and is completely removed with the flushing of the toilet pan without thereby a manual tearing off or taking hold of the individual surface protection being necessary because the perforation tears off from the next individual sheet.

Upon drawing out or upon automatic advancing of the surface protection sheet out of the corresponding receiving space therefore the seat opening in the surface protection paper is released in that there still remains connected to the edge of this opening at the back which covers the inner and rear part of the toilet pan whilst at the same time at the front a flap hangs down and dips with its front end in the water of the toilet pan and thus among other things also protects the male genitals from contact with the toilet pan The use of the rear flap has the advantage that in particular with shallow flush toilet pans the splashing of the water in the shallow flush bowl caused by the dropping in of feces is avoided. With particularly watery stools a soiling of the toilet pan is also avoided thus—as is quite general—due to the flaps projecting into the toilet pan at the front and rear the inside of the toilet pan is kept as free as possible from soiling. Due to the falling in of the rear flap into the water of the toilet pan the flushing effect is still reinforced, that is, on operation of the water flush the surface protection paper is flushed away so that a complete and certain removal is guaranteed. In the present invention independent protection for the special shape and design of the paper surface as a surface protection for the toilet seat is claimed.

In a first embodiment it is preferred for individual sheets separated by perforation to be wound one after the other on an endless roll and for the outer contours of the individual sheet to correspond approximately to the outer contours of the toilet seat and for an inner flap from the individual sheet separable by perforation to be provided the outer contour of which corresponds approximately to the inner contour of the toilet seat.

The essential feature of this embodiment is therefore that individual sheets are separated successively by perforations, are wound on an endless roll and that these individual sheets are capable of being torn off at the the perforations. With the sum of the above described features it is achieved that a toilet seat and a whole toilet arrangement is proposed which corresponds to the highest sanitary requirements. The user is protected in the greatest possible manner from contact with the toilet seat and from contacting the toilet pan on the inside as well as the outside. The toilet pan itself is protected from soiling; furthermore the depositing of insanitary dirt residues—as has been the case in known toilet pans in the region of the rear mounting plate—is obviated with certainty. By the use of a spray nozzle for the liquid cleaning of the anal region the cleaning comfort is still improved.

The subject matter of the present invention does not follow only from the subject matter of the individual patent claims but also from the combination of the individual patent claims with one another.

In the following the invention is explained more precisely with reference to drawings illustrating only several methods of construction. Thereby there follows from the drawing and their description further features and advantages essential to the invention.

Figure 3:
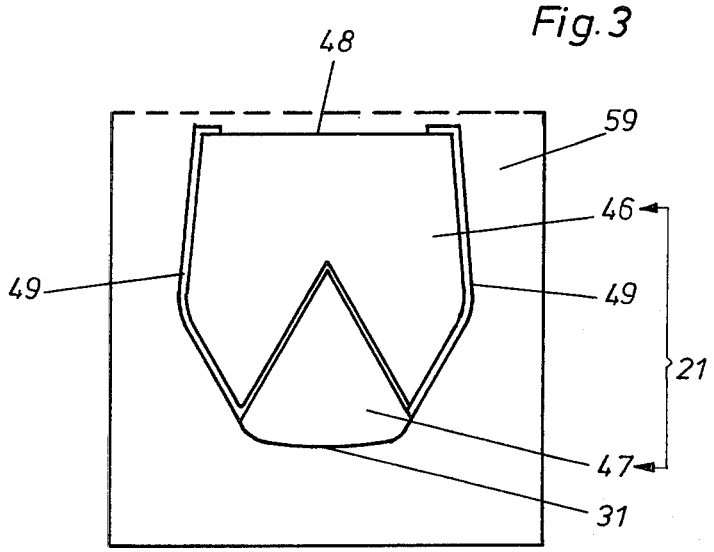
FIG. 3 is a plan view of the individual sheet of a surface protection paper.

FIG. 5*a*–FIG. 5*f* show a plan view of modified embodiments of individual sheets compared with FIG. 3

Figures 6, 7:
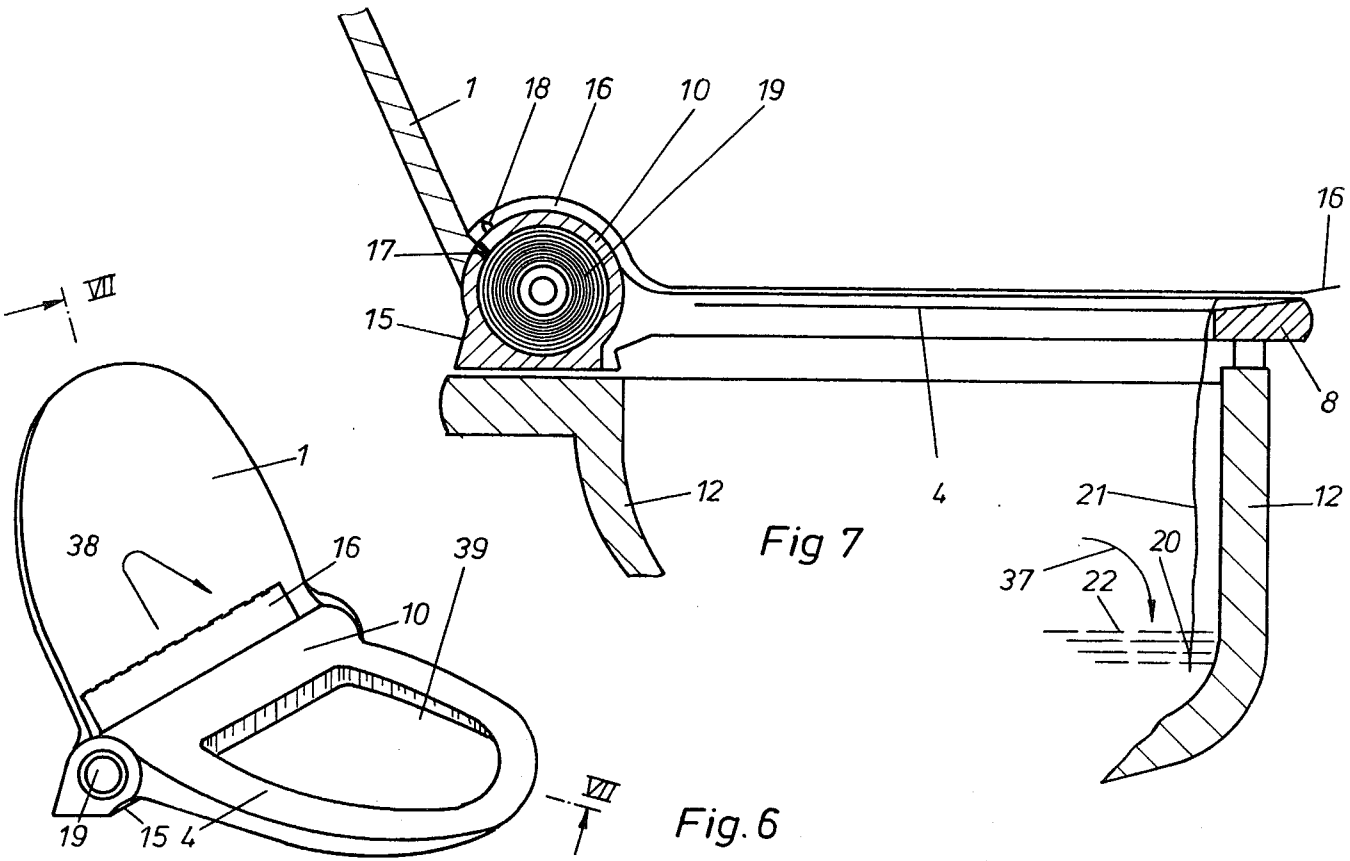

FIG. 6 is a perspective view of a toilet seat in another embodiment with a hollow cylindrical receiving space connected in one piece to the toilet seat for receiving paper protection surfaces.

FIG. 7 is a section on line V11—V11 in FIG. 6

Figure 1:
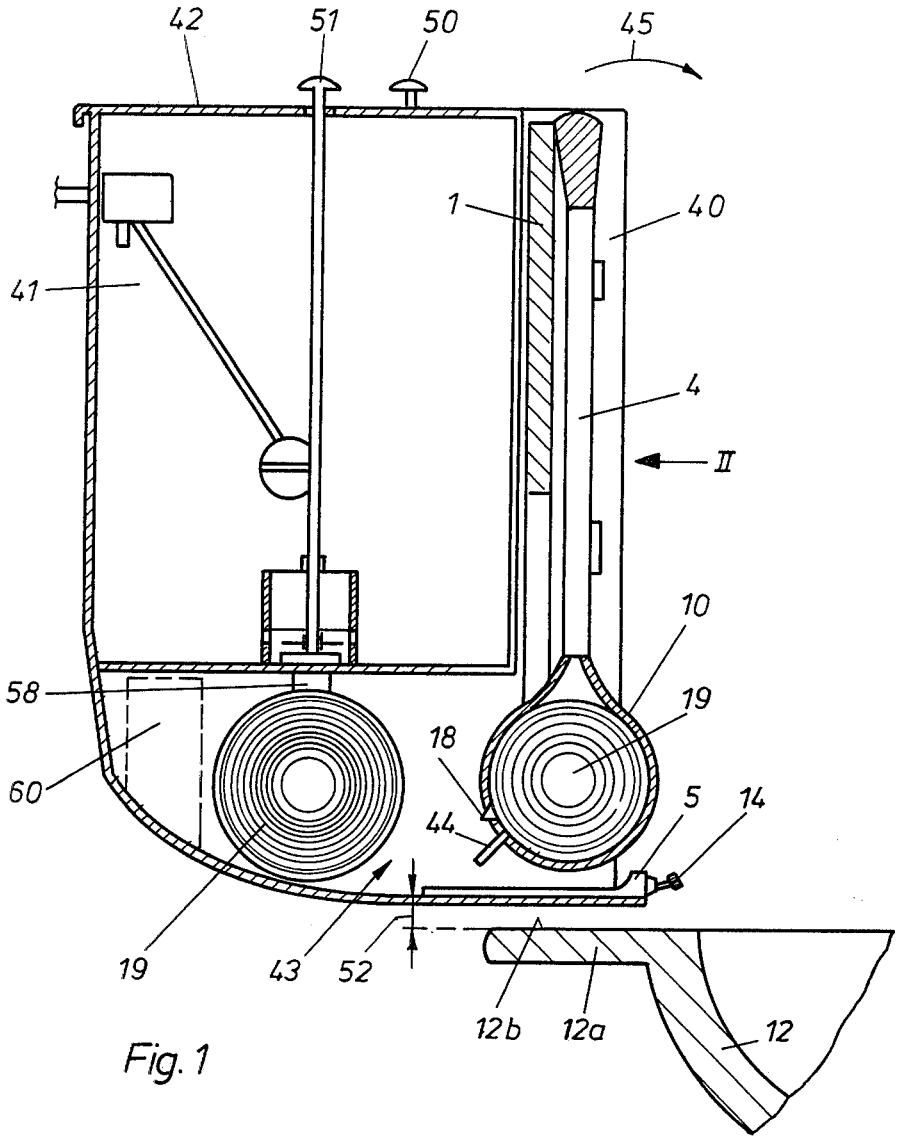
FIG. 1 shows a central longitudinal section through a first embodiment according to the invention in which the box is formed as a flushing box of a water flush

FIG. 1 shows the integration (assembly) of a toilet seat 4 and a lid 1 covering the toilet seat 4 both being illustrated in the tilted up position. In this position the lid 1 and the toilet seat 4 are disposed in a trough 40 of a cistern 41. This gives in conjunction with FIG. 2 an extremely compact construction and a completely new, aesthetic impression of the cistern because in this all operating parts of the toilet are integrated with the exception of the toilet pan 12.

It is essential to the invention that on the toilet pan 12 itself no more parts are mounted so that the rear edge 12*a* of the toilet pan is completely free and does not serve for the fixing of the toilet seat 4 or the lid 1. Thus there results a completely smooth and flat upperside 12*b* of the toilet pan 12 which therefore is particularly easy to clean. The presence of insanitary pockets of dirt is thus certainly avoided. This is because between the upperside 12*b* of the toilet pan 12 and the underside of the cistern 41 a space 52 is left so that the upperside 12*b* of the toilet pan 12 can easily be cleaned. The association of the lid 1 and the toilet seat 4 in respect of the toilet pan 12 is illustrated only diagrammatically. The water box can be placed as desired or with its fixing face to the front or rear or below or above; only it is essential that the toilet seat 4 lies approximately horizontally on the upperside 12*b* of the toilet pan 12 when it is tilted down. In order to achieve this it may also be arranged for the lid 1 and the toilet seat 4 to be suitably bent at an angle. The toilet seat 4 with its joint 2*a* as well as the lid 1 with its joint 3*a* are rotatably mounted in the side wall 41*a* of the cistern 41.

If the box is formed as a cistern 41 as illustrated in FIG. 1 it is necessary to provide two chambers. One chamber serves for receiving the flushing water and in FIG. 1 a conventional flush is illustrated purely diagrammatically. This flush belongs to the prior art and is not included in the present idea of the present invention.

New and inventive however is the fact that instead of a flush knob 51 in all two flush knobs are provided. The second flush knob 50 serves to let out a smaller quantity of water. This serves for saving water in particular when the toilet pan is used only as a urinal.

A second chamber is provided by division of the water chamber of the cistern 41 which serves as a receiving space 43 for taking further units of the toilet.

In the embodiment shown a receiving space 10 for the insertion of an endless role 19 is provided in one piece on the toilet seat 4. This endless roll consists of individual sheets joining on one another as will be described later in conjunction with FIG. 3. The end 44 of the paper of the first individual sheet can be drawn out of the slot 17 of the receiving space 10 so far as the toilet seat 4 is pivoted in the direction of the arrow 45 downwards onto the upperside 12*b* of the toilet pan 12. The end 44 of the paper can then be grasped by the hand and drawn out corresponding to its length as far as the next perforations. The tearing off can then be effected via a tear off edge 18 arranged in the outside of the receiving space 10.

Figure 2:
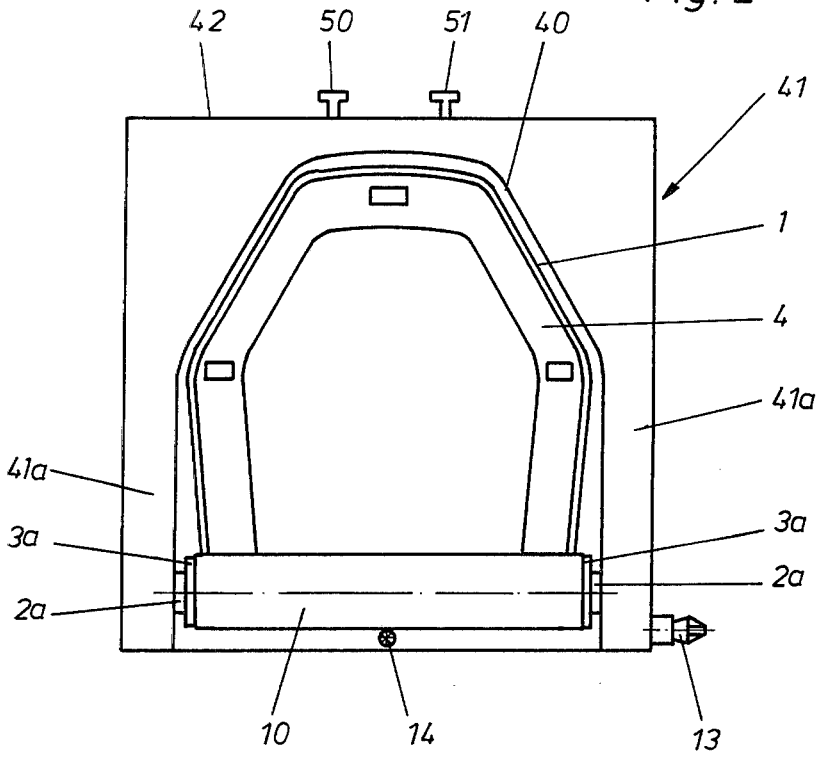
FIG. 2 is a view in the direction of the arrow II in FIG. 1

The receiving space 43 formed in the cistern 41 serves according to the invention at the same time for receiving and storing also a second endless roll 19 which is inserted as a spare roll. The insertion can be effected from the side of the cistern 41 which may be closed by means of a suitable closure, a door or a flap. Furthermore the receiving space 43 is also provided for receiving further units 60, for example, hot water generator or hot air generator. A hot water generator is then built in when in the cistern 41 at the same time an apparatus for the cleaning of the anal region is provided. For this there is disposed on the inside of the bottom part of the cistern 41 a mounting block 5 on which a small spray nozzle 14 is fixed the jet from which is easily inclined upwards directed towards the anal region of the user. The user may then instead of using toilet paper effect a liquid cleaning with the aid of the spray nozzle and the warm water jet sprayed from this spray nozzle. The operating fittings 13 are arranged, for example, in the side wall of the cistern 41 as shown in FIG. 2.

In this embodiment the apparatus for liquid cleaning is integrated in the cistern 41 together with the other aboved described parts such as the toilet seat 4 and the lid 1 as well as the receiving space 10 so that in all an extraordinarily compact and concise construction results which saves a considerable amount of space. Furthermore—as already indicated here—the toilet pan 12 itself is not called upon for the holding of the said parts.

It may furthermore be arranged that in the side wall of the cistern an accommodation and a holding means for a conventional toilet paper roll is provided.

The cistern 41 is covered on its upperside by a lid 42. In a manner not shown in more detail the water then flows out upon operating the flush knob 51, via the flow off pipe 58 from the cistern 41 and is led via a pipe not shown in detail into the toilet pan 12. For the full state regulation of the water level in the cistern 41 a known float control is provided.

FIG. 2 shows that the pivot 2*a* for the seat 4 and the pivot 3*a* for the lid are accommodated in the side walls 41*a* of the flush box.

FIG. 2 furthermore shows that two different flush knobs 50,51 are provided for selectively controlling a larger or smaller quantity of water can be let out according to operation of the respective knob.

Figure 4:
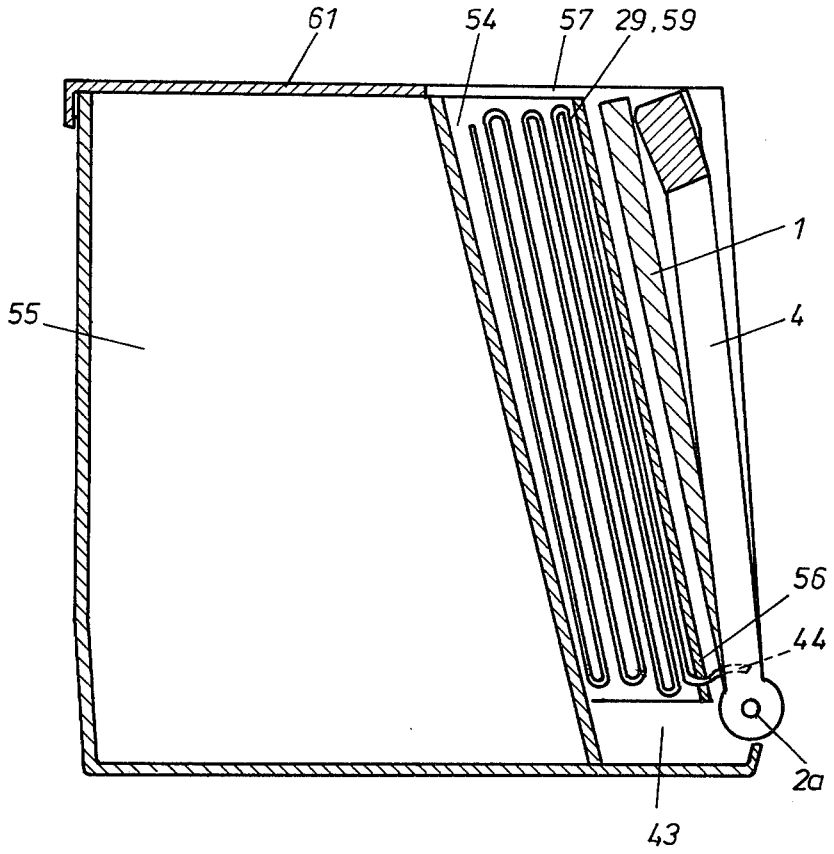
FIG. 4 shows a central longitudinal section drawn diagrammatically through a second embodiment of an arrangement according to the invention whereby only essential parts have been shown.
Figure 5A:
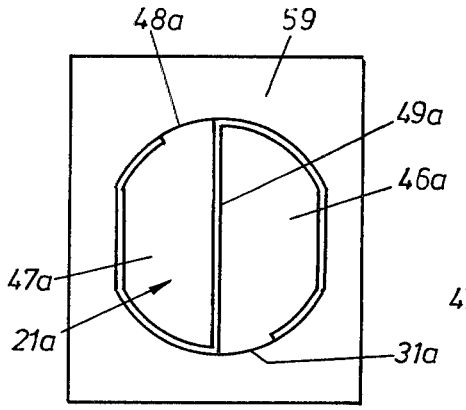
Figure 5D:
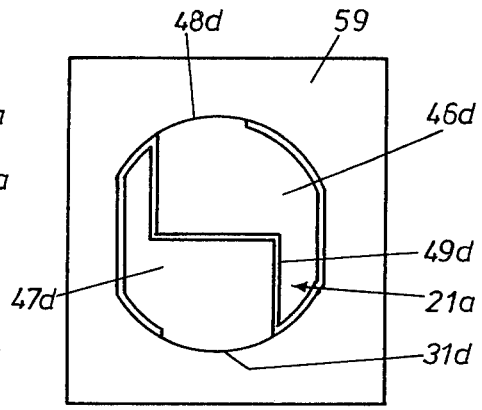
Figure 5B:
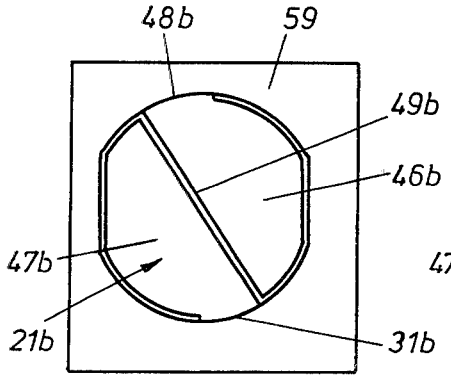
Figure 5E:
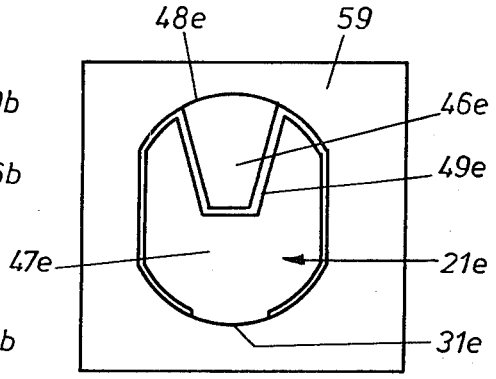
Figure 5C:
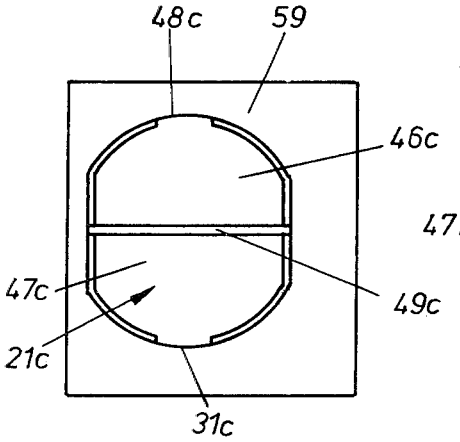
Figure 5F:
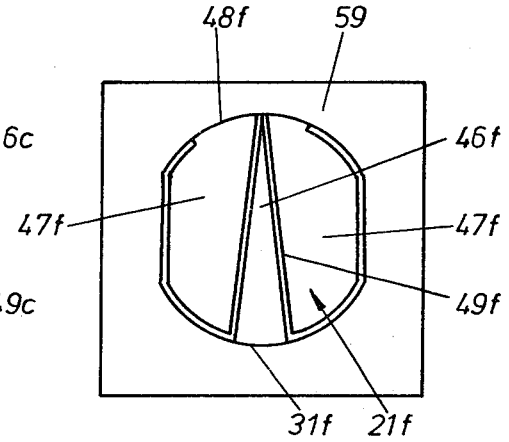

FIG. 4 shows the further embodiment of an arrangement according to the present invention again in central longitudinal section. For this the cistern 55 may be formed either similar to the cistern 41 shown in FIGS. 1 and 2 as a receiving container for the flush water, the cistern 55 may however serve only as a container for the storage of articles in which case the flushing of the toilet pan 12 is effected via a pressure flusher which takes the water directly from the mains.

Furthermore in the embodiment according to FIG. 4 it is essential that instead of the winding of the individual sheets, as shown in FIG. 3, individual sheets 29 and 59 connecting with one another, unfolded on an endless roll 19 be disposed in a receiving space 54 of the cistern 55. The end 44 of the first sheet may be removed via a slot 46 from the receiving space 54. As soon as the first sheet is drawn out the second sheet follows because it is attached to the end of the first sheet by means of perforations. The filling of the receiving space 54 is effected via the opening 57 from above. As far as the remaining chamber of the cistern 55 which is illustrated free in FIG. 5 serves for the storing of articles. A removable lid 61 is provided.

Under the receiving space 54 a further receiving space 43 is formed which can likewise serve for receiving units 60 as described in conjunction with FIG. 1.

FIG. 3 shows the plan view of a new paper protection surface sheet 58. The paper protection surface sheet defines with the slits 49 and inner flap 21 the outer periphery of which corresponds to the inner opening of the toilet pan 12. The inner flap 21 is, according to the invention, devided into two flaps 46, 47 which are separated from one another by slits 49. The rear flap 46 is connected via a continuous piece 48 to the individual sheet 59 and consequently upon drawing over the toilet seat 4 with the individual sheet 59, to the back falls into the toilet pan 12 and covers the rear inner edge of the toilet pan 12 whilst the front flap 47 via a continuous piece 31 is connected to the front part of the individual sheet 59 and upon drawing over the toilet seat 4 with the individual sheet 59 to the front falls onto the toilet seat 4 and covers the front inner edge of the toilet pan 12.

The arrangement of the slits 49 is such that from the rear flap 46 two acute angled flaps are formed whilst the front flap with its free tapering ends is likewise formed as an acute angled flap. This arrangement of acute angled flaps has the advantage that their length is of a size that they immerse with certainty into the toilet pan 12 and consequently are seized by the flush water when the water flush is operated. The flush water then seizes the two flaps 46, 47 and—since these are connected via the pieces 31,48 to the remaining individual sheet 59—the whole individual sheet 59, which consequently is flushed away completely and without manual operation.

By the choice of slits 49 and the piece 48, so that a rear flap 46 and a front flap 47 is separated and during the use of the toilet the toilet pan is covered inside at the front and rear ensuring a greatest possible sanitary use of the toilet arrangement.

The two flaps 46, 47 covering the inside of the toilet pan prevent a soiling of the toilet pan by faeces, urine or water splashing and furthermore prevent the water located in a shallow flush closet pan from splashing up due to the falling in of the faeces.

In FIGS. 5*a*-5*f* modified embodiments of individual sheets compared with the individual sheet shown in FIG. 3 are illustrated. Hereby it is essential for the two individual flaps 47*a-f* and 46*a-f* respectively can be obtained by different cut constructions of the slit 49*a-f*. With the slits 49*a-f* all the cuts illustrated are continuous and are exaggerated as slits so that it can be seen in the Figures how the flaps 46*a–f* and 47*a–f* are obtained from the respective inner flaps 21*a–f*.

In FIG. 6 a toilet seat 4 is shown which is integral with a receiving space 10 disposed in the rear part. The receiving space 10 has the form of a hollow cylinder to receive the endless roll 19. An essential feature of this embodiment is that the front sides of the hollow cylinder are formed as projecting cylindrical stub axles which serve as pivots for the lid 1 pivotally fixed thereon.

The end of a paper protection surface projects from the receiving space 10 which is capable of being drawn out in the direction of the arrow 37 and then covers the whole toilet seat 4 with the seat opening 39.

Further details follow from FIG. 7. In the section it can be seen that the receiving space 10 has a horizontal slit 17 through which the paper protection surface 16 is capable of being drawn out.

In the vicinity of the slit 17 a tear off edge 18 may be provided in order to separate the paper protection surface 16 at a predetermined place. The receiving space is integral with a holder 15 which in its turn has screws or bolts or similar fixing means in order to produce a suitable connection with the toilet pan 12. According to FIG. 6 the paper protection surface is seized and drawn in the direction of the arrow 38 over the toilet seat 4 where it then, according to FIG. 7 covers the whole toilet seat 4 including the edge 8 of the seat. As shown in FIG. 7 it is arranged in this embodiment for the inner flap 21 to penetrate into the water level 22 of the toilet pan 12 so that upon aperating the flush a current of water is produced in the direction of the arrow 37 which draws the inner flap 21 into the toilet pan 12 and thus on the basis of the connection of the piece 31 the whole paper protection surface 16. Thus an automatic removal of the paper protection surface 16 upon operation of the flushing is ensured.

In the embodiments according to FIGS. 5*a–5f* instead of an inner flap 21 two flaps 46, 46*a–46f* and 47, 47*a–47f* have been provided the front flap 47, 47*a–47f* cover the front inner area of the toilet pan 12 and the rear flaps 46, 46*a–46f* the rear inner area of the toilet pan 12.

In the embodiment according to FIGS. 6, 7 it is important for the receiving space 10 which has the form of a hollow cylinder to be integral with the mounting plate for the fixing of the seat 4 on a toilet pan 12, that is, the holder 15 is therefore arranged on the receiving space 10. Thus a conventional toilet seat with lid can be exchanged in a simple manner for the arrangement according to the invention according to FIGS. 6 and 7 without it requiring as large amount of assembly work because the holder is then fixable directly in the toilet pan 15.

I claim:

1. In combination, a toilet bowl, a toilet seat, means hingedly supporting said toilet seat for rotation around a transverse hinge axis adjacent the rear portion of said toilet bowl and allowing the seat to supportingly engage on the rim of said toilet bowl, dispensing housing means adjacent said toilet bowl rear portion mounted coaxially with said hinge axis, and rigidly connected to said seat, and a supply of frangible web material disposed in said dispensing housing means and being of a width sufficient to overlie the toilet seat, said housing means having a dispensing opening in its rear top side arranged to permit withdrawal of the web material to cover the seat, said web material including separable substantially identical main seat cover sheets sucessively movable to a position covering the seat, the seat cover sheets being formed to define on each sheet respective front and rear freely descending flaps of a length sufficient to become at least partially immersed in the water in the toilet bowl and shaped to define a composite opening substantially conforming with the interior of the toilet bowl when said flaps drop to depending positions, said flaps being formed so that the respective flaps assume depending immersed transverse positions adjacent to and shielding the front and rear inside wall surfaces of the toilet bowl.

2. The structural combination of claim 1, and wherein said web material has transverse tearable linear regions between said successively movable main seat cover sheets.

3. The structural combination of claim 2, and wherein said tearable linear regions contain transversely aligned perforations.

4. The structural combination of claim 1, and wherein said flaps have fold axes which extend substantially transversely.

5. The structural combination of claim 1, and wherein said toilet bowl is provided with a water tank adjacent thereto, and wherein said dispensing housing means is located subjacent said water tank.

6. The structural combination of claim 1, and wherein said supply of web material is in the form of a roll coaxially contained in said dispensing housing means.

7. The structural combination of claim 1, and wherein said toilet bowl is provided with a water tank rearwardly adjacent thereto and having a recess arranged to at times receive the toilet seat.

8. The structural combination of claim 1, and wherein said dispensing housing means comprises a cylindrical container coaxial with the toilet seat hinge axis, and wherein said supply of web material is in the form of a roll coaxially rotatably mounted in said container, the container having a longitudinal dispensing slot through which the web material passes.

9. The structural combination of claim 8, and outwardly projecting web-cutting longitudinal blade means mounted on the container adjacent said dispensing slot.

10. The structural combination of claim 8, and wherein the opposite ends of said cylindrical container have respective stub shaft elements, and wherein the toilet seat is pivotally mounted on said stub shaft elements.

11. The structural combination of claim 8, and wherein said toilet seat is integral with said cylindrical container.

12. The structural combination of claim 1, and wherein said toilet bowl is provided with a water tank adjacent thereto and having a bottom compartment, said dispensing housing means being located in said bottom compartment.

13. The structural combination of claim 12, and a spray nozzle mounted in said bottom compartment and being directed toward the toilet bowl for the liquid cleaning of the anal region.

14. The structural combination of claim 1, and wherein said flaps have convergent free end portions to facilitate their penetration into the toilet bowl water and to facilitate automatic removal of the cover sheet responsive to the flushing of the bowl.

15. A toilet with a foldingly supported toilet seat with a cover designed for a single use for the seat, the cover taking the form of a cut-off single sheet, there being a supply of such sheets in the form of a paper roll with perforations between the sheets so that they may readily be separated from each other, the roll being housed at a position clear of the toilet bowl in a container which has a slot for taking the single sheets from the container characterized in that the container for the paper roll is coaxially mounted at the turning support, or hinge, for the seat and is rigidly connected to the seat so as to rotate therewith, and in that the slot in the container for the supply of single sheets is in the rear top side of the container when the toilet seat is in folded-down position on the toilet bowl.

16. The toilet of claim 15, and wherein the toilet includes an upstanding cistern adjacent the toilet bowl said cistern having opposite side wall front extensions defining a recess, the toilet seat being rotatable to an upstanding position, and wherein the coaxiallly mounted seat turning support and container are pivotally mounted between the lower portions of said side wall front extensions so that the toilet seat can be received in said recess when it is rotated to said upstanding position.

* * * * *